US005639133A

United States Patent [19]

Mote

[11] Patent Number: 5,639,133

[45] Date of Patent: Jun. 17, 1997

[54] ERGONOMIC BALL RETRIEVER AND DISPENSER

[76] Inventor: Kyle W. Mote, 3055 Mirada Rd., Highland, Calif. 92364

[21] Appl. No.: 531,937

[22] Filed: Sep. 21, 1995

[51] Int. Cl.[6] ..... A63B 47/02

[52] U.S. Cl. ..... 294/19.2; 206/315.9; 473/286; 473/517

[58] Field of Search ..... 273/29 R, 29 A; 294/19.2; 206/315.9

[56] References Cited

U.S. PATENT DOCUMENTS

| | | | |
|---|---|---|---|
| 2,203,170 | 6/1940 | MacDonald | 294/19.2 |
| 2,516,622 | 7/1950 | George | 294/19.2 X |
| 3,117,814 | 1/1964 | Webb | 294/19.2 |
| 3,316,008 | 4/1967 | Baugh, Jr. | 294/19.2 |
| 3,371,950 | 3/1968 | Stap | 294/19.2 X |
| 3,558,170 | 1/1971 | Stanworth | 294/19.2 |
| 4,063,769 | 12/1977 | Zimmer | 294/19.2 |
| 5,188,410 | 2/1993 | Summers | 294/19.2 |
| 5,340,179 | 8/1994 | Rubin | 294/19.2 |
| 5,505,510 | 4/1996 | Duncan | 294/19.2 |

*Primary Examiner*—Bryon P. Gehman
*Attorney, Agent, or Firm*—Donald W. Meeker

[57] ABSTRACT

A ball container and dispenser is elevated in a standing position by a downwardly extending ball pickup tube and pivotable stand. The tube angles away from the container and dispenser so that the bottom of the tube is forward of the container and dispenser to pick up balls in front of the user. A hinged lid removably covers a top ball dispensing opening in the container and dispenser. The stand pivots to serve as a combination stand in the down position and lid locker in the up position. The rigid element snap fits into paired ridges protruding from the container and dispenser. A handle integral with the lid is shaped like a sports equipment handle and slopes toward the rear. The bottom of the tube is parallel to the ground and has a circular opening smaller than the ball. For hard balls, the opening has radial slots around the perimeter creating resilient tabs.

15 Claims, 1 Drawing Sheet

ERGONOMIC BALL RETRIEVER AND DISPENSER

DESCRIPTION

BACKGROUND OF THE INVENTION

1. Technical Field

The present invention relates to sports ball retrieval apparatus and in particular to a sports ball retriever and dispenser ergonomically structured with a sloping ball pickup tube for picking up balls while walking in an upright position and an elevated ball container for storage and easy-access dispensing.

2. Description of the Prior Art

In tennis, golf, baseball, ping pong, and many other sports, players use a number of balls for practicing hitting or throwing. Retrieving the balls for repeated reuse in practicing and containing the balls for easy access are important to make practicing easier and more enjoyable so that the player doesn't waste time and become distracted with the logistics of ball retrieval and reuse. Securing the balls for transporting and storage is also an important consideration in making practice easier and preventing the loss of balls.

Prior art devices for sports ball retrieval have vertical ball intake means necessitating standing over the ball and pushing straight down on the ball to retrieve it with the hand of the player in an awkward position which could tire the player's arm and lead to injury. In order to see the ball underneath the prior art devices, the player has to bend down.

The wire cage type ball retrievers have a flat bottom with spaced parallel wires across the bottom, through which the balls are passed for retrieval. The wires tend to become bent out of shape and fail to work properly with repeated usage.

Open basket prior art ball retrievers present a spilling problem in transporting them. These devices have two very long handles of relatively thin wire which can pinch the hand of the player between the handles. These devices require swiveling both handles down under the wire storage basket to elevate the basket and position the two handles under the basket to support the basket for dispensing balls to the player. Unless two people perform the operation, the player is likely to spill out some of the balls in performing the maneuver.

Prior art ball retrievers having two long handles and an open-topped basket are very difficult to carry because the arm must be held up high to accommodate the length of the handles, and very difficult to store, especially in a vehicle trunk or closet because the handles protrude too far on both sides to fit in a trunk or standard closet. Manipulating the basket and fitting it into a small storage space without spilling the balls is very challenging.

Prior art ball retrievers with flexible tabs at the point of admitting the balls present a problem in that the tabs break very easily.

DISCLOSURE OF THE INVENTION

The present invention is ergonomically structured so that it may be used to retrieve sports balls while the player walks in a natural comfortable position with the invention held with the arm and hand of the player in a natural comfortable downwardly extended position. The present invention provides a sloping ball pickup tube protruding forward of the ball container and dispenser providing a clear field of vision of the end of the tube to allow the player to see accurately when the end of the pickup tube is positioned over the ball to retrieve the ball easily by pressing the end of the pickup tube down onto the ball on the ground in front of the player with the player walking in a normal upright position with the arm holding the invention in a natural comfortable downwardly extended position. Providing a cylindrical pickup tube larger in diameter than the ball allows a series of balls to move up the pickup tube with each ball as it enters the end of the pickup tube pushing the previously entered balls up the tube.

Providing an end opening in the pickup tube slightly smaller in diameter than the ball retains the balls in place within the pickup tube. For resilient balls, such as tennis balls, the resiliency of the ball will allow the ball to squeeze into the tube. For hard balls, such as golf balls, baseballs, and ping pong balls, the end opening is made flexible by forming radial slits through the tube wall around the opening creating flexible tabs which bend inwardly to admit the hard ball therein, or by other flexible opening means.

An enlarged cavity extending away from the pickup tube along the top half of the pickup tube forms a ball container and dispenser providing storage and an elevated dispenser for the balls. Providing a sloping pickup tube causes the balls to fall into the ball container and dispenser automatically under force of gravity as each ball reaches the ball container and dispenser being pushed up the pickup tube by the balls below as they enter the pickup tube. An elevated ridge across an interior bottom surface of the ball container and dispenser adjacent to the pickup tube prevents the balls from falling back into the pickup tube. The ball container and dispenser has a top opening to allow easy access to the balls contained therein. The ball container and dispenser is positioned along the ball pickup tube and the center of gravity of the invention is such that the invention automatically assumes the correct position for ball pickup when held by a handle at the top of the invention, so that the player merely approaches the ball and presses down on the invention without requiring any additional manipulation.

A lid, hinged to the top front wall of the ball pickup tube, fits over the opening at the top of the ball container and dispenser to contain the balls therein during the retrieval operation and during transportation and storage of the invention. Extending out of the lid, adjacent to the hinge, a thick handle base tapers upwardly and rearwardly to form a handle spaced away from the lid. The handle is angled slightly downwardly toward the rear of the invention to form a comfortable angle for holding the invention in a natural straight wrist position with the invention in the ball retrieval orientation. The handle is a full grip handle shaped and sized like a handle on sporting equipment related to the sport. The tennis ball pickup embodiment of the invention has a handle shaped and sized like the end of a tennis raquet. The golf ball pickup embodiment of the invention has a handle shaped and sized like the end of golf club. The baseball pickup embodiment of the invention has a handle shaped and sized like the end of a baseball bat. The ping pong ball pickup embodiment of the invention has a handle shaped and sized like the end of a ping pong paddle handle. The handles all provide a full-hand grip with the handle held againts the palm of the hand, the fingers and thumb wrapped around the handle on opposing sides of the handle.

A U-shaped combination stand and lid locker is pivotally attached to opposing exterior sides of the ball container and dispenser adjacent to a back wall. The combination stand and lid locker pivots downwardly into a lower vertical position contacting the ground to form a stand in conjunction with the bottom of the ball pickup tube resting on the ground for using the invention in the ball dispensing mode with the lid pivoted into an open position. Pivoted upwardly to an upper vertical position, the combination stand and lid locker loops over the closed lid to secure the lid in place for using the invention in the ball retriever mode or ball storage mode. The combination stand and lid cover is secured in place in the upper position by a pair of protruding ridges on each exterior side of the ball container and dispenser near the top above the attaching points of the combination stand and lid locker. It is held in place in the lower position by a pair of protruding ridges on each exterior side of the ball container and dispenser near the bottom below the attaching points. The combination stand and lid locker snap fits into the ridges.

With the combination stand and lid locker closed over the lid, the handle on the lid serves as a carrying handle for the invention. With the combination stand and lid locker pivoted down in the stand position, the handle serves to open the lid for access to the balls in the ball container and dispenser.

The combination stand and lid locker is formed by two straight parallel spaced apart side pieces meeting with a joining end piece at fight angles to the side pieces. The straight bottom of the combination stand and lid locker provides a stable base in the lowered stand position. The top side edges of the lid are rounded so that the basically squared corners of the U-shaped combination stand and lid locker protrude beyond the rounded lid comers for easy access to the combination stand and lid locker for snapping it into and out of place over the lid. The other ends of the side pieces are bent inwardly and inserted pivotally in mating sized holes in the side walls of the ball container and dispenser.

The ball pickup tube, ball container and dispenser, lid, and handle are formed in one piece by roto molded or blow molded plastic, such as polyethylene for durability, light weight, and ease of manufacturing. The combined lid and handle are molded with a small piece between the lid and the ball container and dispenser which is cut away. A cylindrical opening is molded into the lid and a mating cylindrical opening is molded in the top of the front of the ball pickup tube so that sliding a pin through the two mating cylindrical openings forms a hinge between the lid and the ball pickup tube.

BRIEF DESCRIPTION OF THE DRAWING

These and other details of my invention will be described in connection with the accompanying drawings, which are furnished only by way of illustration and not in limitation of the invention, and in which drawings.

BEST MODE FOR CARRYING OUT THE INVENTION

Figure 1:
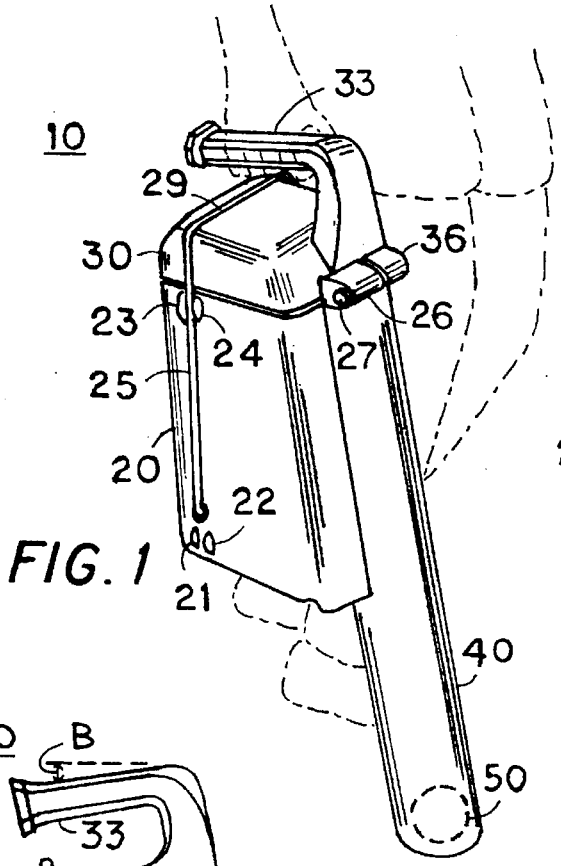
FIG. 1 is a perspective view of the ergonomic ball retriever and dispenser in use picking up a ball.

In FIGS. 1, a ball retriever and dispenser apparatus 10 is shown held in the hand of a player (shown dashed) picking up sports balls 50, such as tennis balls. Also shown in FIGS. 2 and 3, a ball container and dispenser portion 20 has an interior cavity 18 sufficiently large to contain a plurality of the sports balls 50 and having a top opening 19 communicating with the interior cavity through which top opening the plurality of sports balls 50 may be withdrawn for use in playing or practicing the sport.

Figure 2:
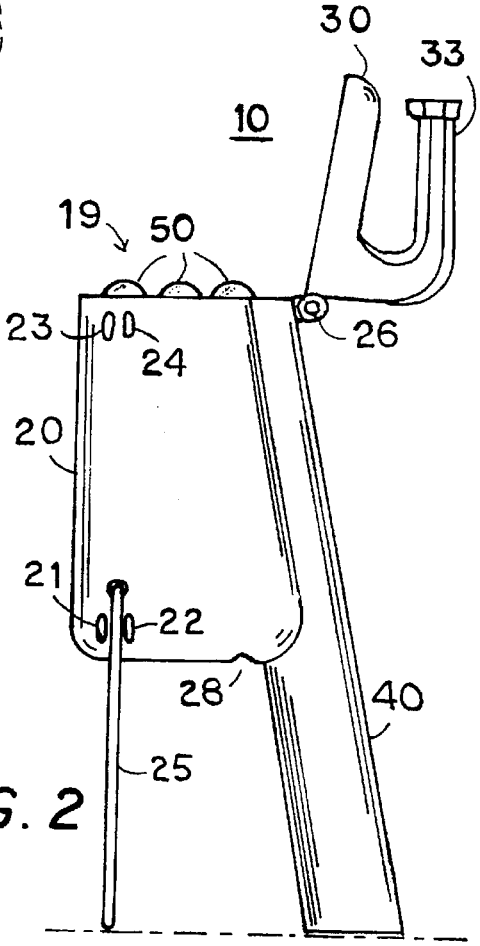
FIG. 2 is a side elevational view of the invention with the combination stand and lid locker down in the stand position and the lid open for dispensing balls.

A ball pickup tube 40 is attached to a front portion of the ball container and dispenser 20 and extends downwardly therefrom at an outwardly extending angle A (approximately 10 degrees from the vertical) so that a distal end of the ball pickup tube extends forwardly of the ball container and dispenser when the apparatus is in an upright position. The forward angled projection of the ball pickup tube allows the distal end of the tube to be in clear view of the player holding the invention and walking in a normal upright position to enable the player to position the end of the tube accurately for picking up each ball. FIG. 1 shows that the end of the ball pickup tube is in front of the player when in use. For optimum efficiency of use to gain the most power from pushing the apparatus down onto the ball, the bottom surface of the ball pickup tube is angled to the ball retriever tube so that the bottom surface is parallel to the ground when in use, as best seen in FIG. 2.

The ball pickup tube 40 has an interior opening along its length larger than the diameter of the sports balls so that the sports balls 50 may pass therethrough pushed up the angled tube. The distal end of the tube is provided with an opening means 44 for admitting the passage of at least one of the sports balls into the tube and preventing the passage of the at least one of the sports balls out of the tube. The interior opening of the tube opens into the interior cavity of the ball container and dispenser to enable the at least one of the sports balls to pass from the tube into the interior cavity as the balls are pushed up the tube by the force of each new ball entering the tube at the bottom. The sloping tube assists in causing the balls to "fall into" the interior cavity.

The ball container and dispenser 20 further comprises a horizontal bottom surface and a vertical ridge 28 protruding therefrom, between the interior cavity of the ball container and dispenser and the interior opening of the ball pickup tube so that the sports balls remain in the interior cavity without falling back down into the tube.

Figure 4:
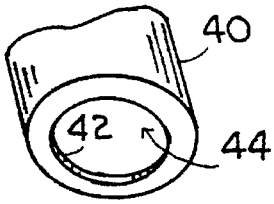
FIG. 4 is a partial perspective view of the end of the pickup tube with a smooth rim around the opening for receiving resilient balls.

In FIG. 4, the opening means 44 comprises a bottom surface of the ball pickup tube having a circular opening surrounded by a solid rim 42 smaller than the diameter of one of the sports balls and the sports balls comprise resilient balls 50, such as tennis balls, so that each of the sports balls is compressible to fit into the circular opening when forced therethrough.

Figure 5:
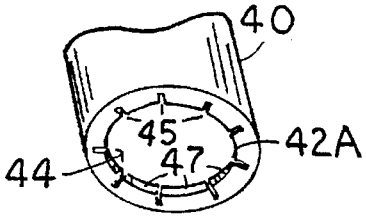
FIG. 5 is a partial perspective view of the end of the pickup tube with a slotted rim around the opening for receiving hard balls.

In FIG. 5, the opening means 44 comprises a bottom surface of the ball pickup tube being formed of a semiresilient material and having a circular opening smaller than the diameter of one of the sports balls and radial slots 45 cut around the perimeter so that a series of semiresilient tabs 47 are formed around the circular opening for admitting one of the sports balls through the circular opening when forced therethrough. The downward force of the player on the apparatus is sufficient to force the ball into the tube, but the force of gravity pulling the ball down is not sufficient to force the ball out of the tube, so the balls remain in the tube.

The top opening 19 is removably covered by a lid 30 which is pivotally attached by a hinge 26 and 36 to a front side of the top opening. The hinge is preferably formed in two mating halves positioned side by side with a pin 27 through both halves. One half is formed integral with the lid 30 and the other half is formed integral with the ball pickup tube. The lid 30 removably covers the top opening 19 so that, with the lid in a closed position as in FIGS. 1 and 3, the sports balls are confined in the ball container and dispenser 20.

Figure 3:
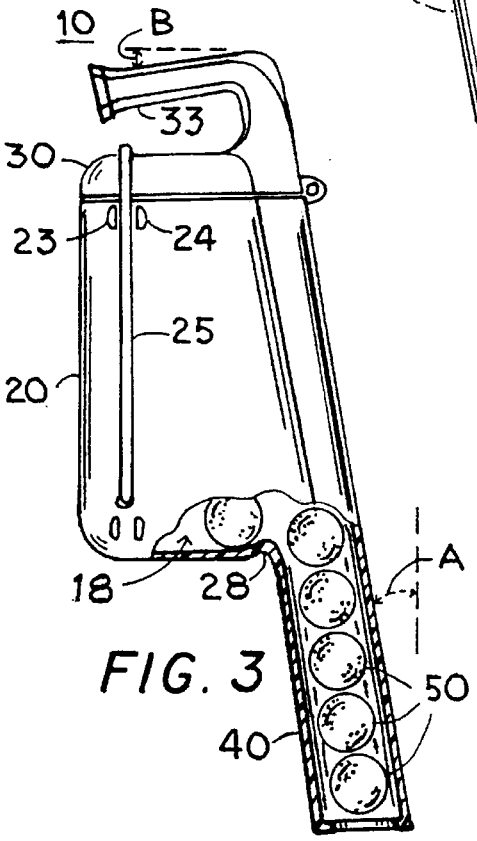
FIG. 3 is a side elevational view in partial section of the invention with the lid locked closed showing the balls in the pickup tube.

The apparatus further comprises a means for supporting the apparatus in an upright stationary position so that the top opening 19 faces upwardly for withdrawing the sports balls therethrough, the means comprising a rigid element 25 and 29, herein called a combination stand and lid lock, pivotally attached to the ball container and dispenser so that, in a lower position as in FIG. 2, the combination stand and lid locker contacts an external support surface such as the ground and, in an upper position as in FIGS. 1 and 3, the combination stand and lid locker locks the lid in a closed position. The combination stand and lid locker comprises a U-shaped element having two side legs 25, each pivotally attached to the ball container and dispenser at a pivot point on opposing sides of the ball container and dispenser, and the side legs are connected together at a distal end by a cross bar 29 which alternatingly contacts the support surface and straddles the lid looping over the lid locking it in place.

At least one pair of first protruding ridges 23 and 24 are formed in the ball container and dispenser 20 above the pivot point and at least one pair of second protruding ridges 21 and 22 below the pivot point on each of the opposing sides of the ball container and dispenser so that the side legs 25 engage the protruding ridges with a snap fit to secure the U-shaped element alternately in the upper position acting as a lid lock as in FIGS. 1 and 3 and in the lower position acting as a stand as in FIG. 2. The forward protruding ridges 22 and 24 are larger than the rearward protruding ridges 21 and 23 to act as stops, preventing the combination stand and lid locker from pivoting beyond the forward protruding ridges.

A handle 33 serves as a means for positioning the apparatus so that the distal end of the pickup tube 20 is placed in contact with at least one of the plurality of sports balls 50 for causing the at least one of the sports balls to pass into the opening means 44. The handle 33 is preferably formed as a protrusion from the lid 30. With the combination stand and lid locker in the lower position, the handle 33 may be grasped for pivoting the lid to an open position, as in FIG. 2. With the lid in a locked closed position as in FIGS. 1 and 3, the handle 33 may be grasped for manually positioning the apparatus in operation retrieving balls or transporting the apparatus. The handle 33 comprises a grasping portion spaced away from the lid and sloping downwardly from a front end to a back end at an angle B, as seen in FIG. 3 so that the grip in natural for the player with the arm normally extended downward and the wrist relatively straight for maximum strength and effectiveness. The grasping portion is shaped like a handle on a piece of sports equipment used with the sports balls, such as the tennis-racquet shaped handles of FIGS. 1, 2, and 3.

The entire apparatus, with the exception of the combination stand and lid locker 25 and 29 and hinge pin 27, is formed of durable lightweight plastic which is roto molded or blow molded in one piece which is then separated into the lid 30 with integral handle 33 and the ball container and dispenser 20 with integral ball pickup tube 40. The combination stand and lid locker and hinge pin are formed of steel rods.

It is understood that the preceding description is given merely by way of illustration and not in limitation of the invention and that various modifications may be made thereto without departing from the spirit of the invention as claimed.

What is claimed is:

1. A ball retriever and dispenser apparatus for picking up, storing, and dispensing sports balls, the apparatus comprising:

a ball container and dispenser having ball containing surfaces, including a front portion facing forwardly and a bottom surface, defining an interior cavity sufficiently large to contain a plurality of the sports balls and having a top opening communicating with the interior cavity through which top opening the plurality of sports balls may be withdrawn;

a ball pickup tube attached to the front portion of the ball container and dispenser and extending downwardly and forwardly at an outwardly extending angle from the ball container and dispenser and having a distal end of the ball pickup tube extending and protruding forwardly of the front portion of the ball container and dispenser when the apparatus is in an upright position so that the distal end of the ball pickup tube is visible to a user standing in an upright position holding the ball retriever and container, the ball pickup tube having an interior opening along its length larger than the diameter of the sports balls so that the sports balls may pass therethrough, and the distal end provided with an opening means for admitting the passage of at least one of the sports balls into the tube and preventing the passage of the at least one of the sports balls out of the robe, the interior opening of the tube communicating with the interior cavity of the ball container and dispenser to enable the at least one of the sports balls to pass from the robe into the interior cavity;

a means for positioning the apparatus so that the distal end of the pickup tube is placed in contact with at least one of the plurality of sports balls for causing the at least one of the sports balls to pass into the opening means.

2. The apparatus of claim 1 further comprising a means for supporting the apparatus in an upright stationary position so that the top opening faces upwardly for withdrawing the sports balls therethrough.

3. The apparatus of claim 2 further comprising a lid for removably covering the top opening so that, with the lid in a closed position, the sports balls are confined in the ball container and dispenser.

4. The apparatus of claim 3 wherein the means for supporting the apparatus comprises a rigid element pivotally attached to the ball container and dispenser so that, in a lower position, the rigid element contacts an external support surface and, in an upper position, the rigid element locks the lid in a closed position.

5. The apparatus of claim 3 wherein the opening means comprises the bottom surface of the ball pickup tube having a circular opening smaller than the diameter of one of the sports balls, the circular opening adapted to receive resilient sports balls, when compressibly forced therethrough.

6. The apparatus of claim 5 wherein the bottom surface of the ball pickup tube is angled to the ball retriever tube so that the bottom surface is parallel to the ground when in use.

7. The apparatus of claim 3 wherein the opening means comprises a bottom surface of the ball pickup tube being formed of a semiresilient material and having a circular opening smaller than the diameter of one of the sports balls and radial slots cut around the perimeter so that a series of semiresilient tabs are formed around the circular opening for admitting one of the sports balls through the circular opening when forced therethrough.

8. The apparatus of claim 3 wherein the ball container and dispenser further comprises a horizontal bottom surface and a vertical ridge protruding therefrom, between the interior cavity of the ball container and dispenser and the interior opening of the ball pickup tube so that the sports balls remain in the interior cavity.

9. A ball retriever and dispenser apparatus for picking up, storing, and dispensing sports balls, the apparatus comprising:

a ball container and dispenser having containing surfaces, including a front portion and a bottom surface, defining an interior cavity sufficiently large to contain a plurality of the sports balls and having a top opening communicating with the interior cavity through which top opening the plurality of sports balls may be withdrawn;

a ball pickup tube attached to the front portion of the ball container and dispenser and extending downwardly therefrom at an outwardly extending angle having a distal end of the ball pickup tube extending forwardly of the front portion of the ball container and dispenser when the apparatus is in an upright position, the ball pickup tube having an interior opening along its length larger than the diameter of the sports balls so that the sports balls may pass therethrough, and the distal end provided with an opening means for admitting the passage of at least one of the sports balls into the tube and preventing the passage of the at least one of the sports balls out of the tube, the interior opening of the tube communicating with the interior cavity of the ball container and dispenser to enable the at least one of the sports balls to pass from the tube into the interior cavity;

a means for positioning the apparatus so that the distal end of the pickup tube is placed in contact with at least one of the plurality of sports balls for causing the at least one of the sports balls to pass into the opening means;

a means for supporting the apparatus in an upright stationary position so that the top opening faces upwardly for withdrawing the sports balls therethrough;

a lid for removably covering the top opening so that, with the lid in a closed position, the sports balls are confined in the ball container and dispenser;

wherein the means for supporting the apparatus comprises a rigid element pivotally attached to the ball container and dispenser so that, in a lower position, the rigid element contacts an external support surface and, in an upper position, the rigid element locks the lid in a closed position.

10. The apparatus of claim 4 wherein the rigid element comprises a U-shaped element having two side legs each pivotally attached to the ball container and dispenser at a pivot point on opposing sides of the ball container and dispenser, the side legs connected together at a distal end by a cross bar which alternatingly contacts the support surface and straddles the lid.

11. The apparatus of claim 10 wherein the ball container and dispenser further comprises at least one pair of first protruding ridges above the pivot point and at least one pair of second protruding ridges below the pivot point on each of the opposing sides of the ball container and dispenser so that the side legs engage the protruding ridges with a snap fit to secure the U-shaped element alternately in the upper position and the lower position.

12. The apparatus of claim 4 wherein the means for positioning the apparatus comprises a handle protruding from the lid so that the handle may be grasped for manually positioning the apparatus with the lid in a locked closed position.

13. The apparatus of claim 12 wherein the lid is pivotally attached to a front side of the top opening so that the handle may be grasped for pivoting the lid to an open position with the rigid element in the lower position.

14. The apparatus of claim 12 wherein the handle comprises a grasping portion spaced away from the lid and sloping downwardly from a front end to a back end.

15. The apparatus of claim 14 wherein the grasping portion is shaped like a handle on a piece of sports equipment used with the sports balls.

* * * * *